US011412324B1

(12) United States Patent
Ramamoorthy

(10) Patent No.: US 11,412,324 B1
(45) Date of Patent: Aug. 9, 2022

(54) SPEAKER ARRAY FOR MULTI-CHANNEL SURROUND SOUND HOME

(71) Applicant: Victor Ramamoorthy, Bangalore (IN)

(72) Inventor: Victor Ramamoorthy, Bangalore (IN)

( * ) Notice: Subject to any disclaimer, the term of this patent is extended or adjusted under 35 U.S.C. 154(b) by 0 days.

(21) Appl. No.: 17/180,488

(22) Filed: Feb. 19, 2021

Related U.S. Application Data

(60) Provisional application No. 62/978,421, filed on Feb. 19, 2020.

(51) Int. Cl.
*H04R 1/40* (2006.01)
*H04R 3/12* (2006.01)
*H04R 1/02* (2006.01)

(52) U.S. Cl.
CPC ..... *H04R 1/403* (2013.01); *H04R 1/025* (2013.01); *H04R 3/12* (2013.01); *H04R 2201/401* (2013.01); *H04R 2201/403* (2013.01); *H04R 2201/405* (2013.01)

(58) Field of Classification Search
CPC ..... H04S 7/302; H04S 7/303; H04R 1/005; H04R 1/025; H04R 1/227; H04R 1/40; H04R 1/403; H04R 5/00; H04R 5/02; H04R 2201/025
See application file for complete search history.

(56) References Cited

U.S. PATENT DOCUMENTS

2010/0135505 A1* 6/2010 Graebener ..... H04R 1/403 381/82

FOREIGN PATENT DOCUMENTS

DE 4422500 A1 * 3/1995 ..... H04R 1/02

* cited by examiner

*Primary Examiner* — Kile O Blair
(74) *Attorney, Agent, or Firm* — Pillsbury Winthrop Shaw Pittman LLP

(57) ABSTRACT

Disclosed is a speaker array for home theater and mini theater applications. The speaker array is built around a subwoofer speaker in a cylindrical enclosure. The speaker array may provide a good trade-off between the amount of equipment used and the theatre-quality sound produced. The speaker array can be placed on the floor level as a single unit for small home living room or multiple units for a large performance space. The multiple units deployed can coordinate with each other. The speaker array can be static, static with space measurement sensors, or moving with a motion-controlled platform.

20 Claims, 20 Drawing Sheets

SPEAKER ARRAY FOR MULTI-CHANNEL SURROUND SOUND HOME

CROSS-REFERENCE TO RELATED APPLICATIONS

The present application claims priority to U.S. Provisional Patent Application No. 62/978,421 filed on Feb. 19, 2020 entitled "SPEAKER ARRAY FOR MULTI-CHANNEL SURROUND SOUND HOME", the contents of which are incorporated by reference in their entirety.

BACKGROUND

Multi-Channel Surround Systems such as Dolby Atmos and DTS-X employ a large number of speakers to render realistic movement of sound inside a theater. A large collection of speakers is housed on the theater walls and on the ceiling. The target sound "object" in the case of Dolby Atmos is rendered by injecting appropriate sound information to nearby set of speakers. In a movie theater, a large collection of speaker installation is not a problem. However, when such a system is aimed towards home applications, cost-effective and performance-preserving solutions become very difficult to achieve. In a home theater application, the volume and space occupied by the speaker system is judged to be premium and expensive. Homeowners prefer small and compact home theater equipment. Installing speaker units on the ceiling of living room will be rejected by the homeowner. The user preference is to have a minimum of equipment yet have the best sound mimicking what is heard at the movie theater.

DETAILED DESCRIPTION

Embodiments are directed to a speaker array for home theater and mini theater applications. In some embodiments, a speaker array is built by placing multiple speakers around a subwoofer speaker in a cylindrical enclosure. The speaker array may provide a good trade-off between the amount of equipment and the theatre-quality sound produced. The cylindrical speaker array can be placed on the floor level as a single unit for small home living room or multiple units for a large performance space. The multiple units deployed can coordinate with each other. The cylindrical speaker array can be static, static with space measurement sensors, or moving with a motion-controlled platform.

Figure 1:
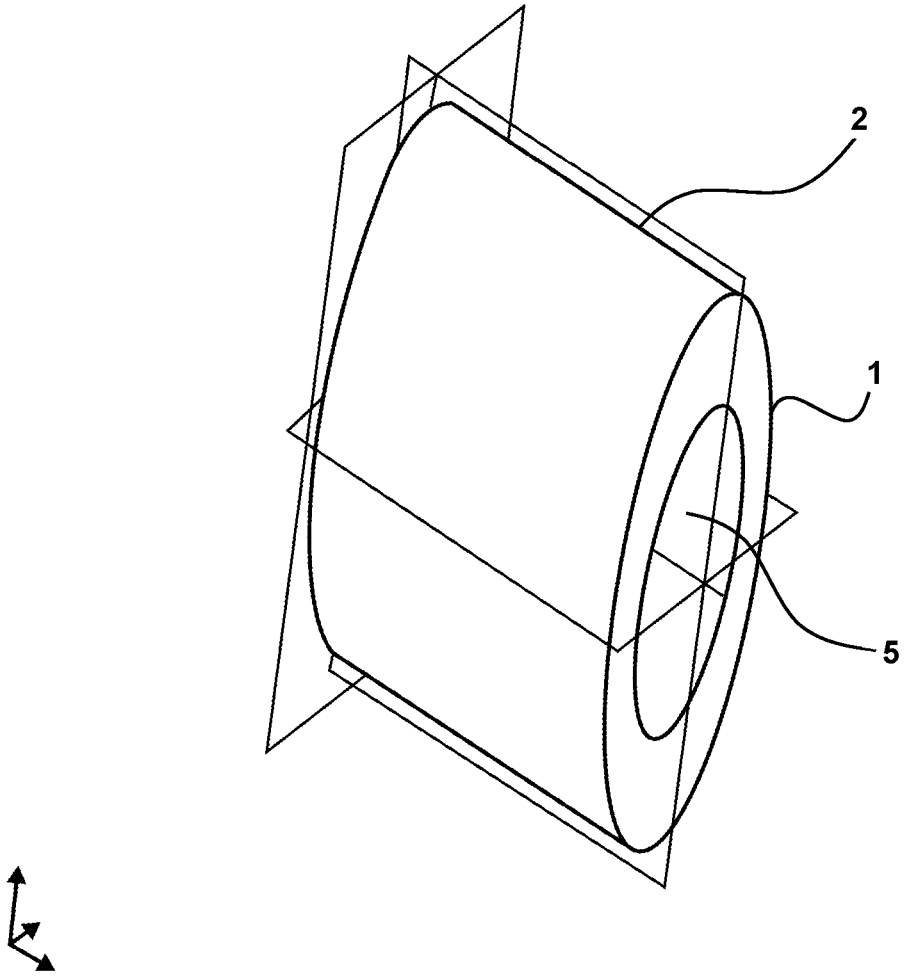
FIG. 1 shows a cylindrical tube used to construct a cylindrical speaker array, consistent with various embodiments.
Figure 2:
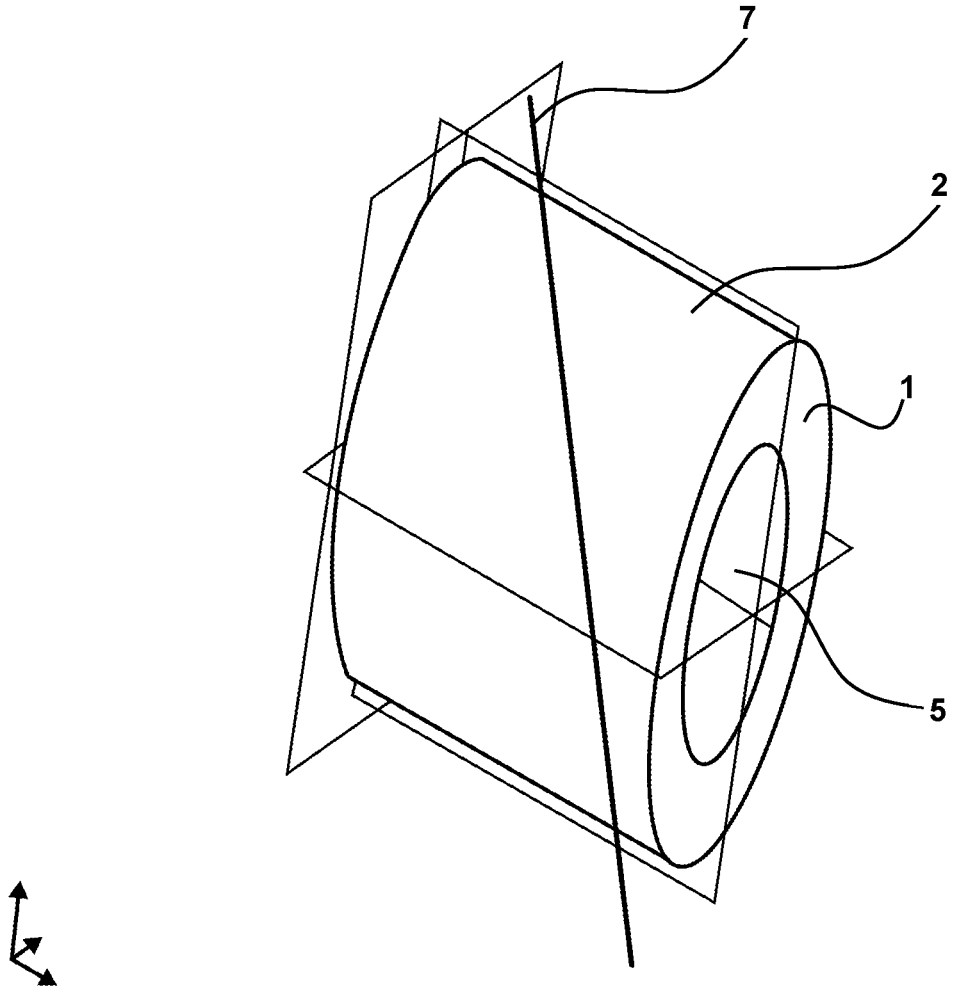
FIG. 2 shows a cutting plane across which an annular elliptical surface is to be formed on the cylindrical tube, consistent with various embodiments.
Figure 3:
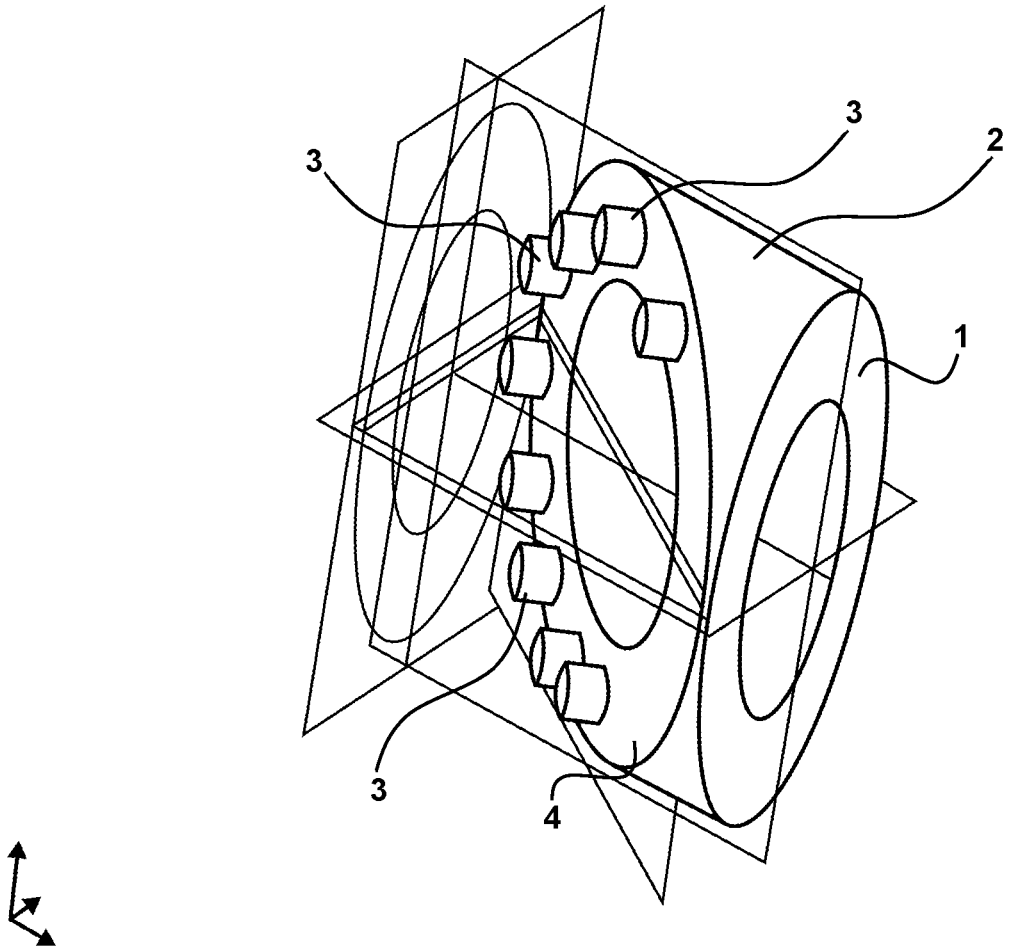
FIGS. 3, 4 and 5 show various views of the annular elliptical surface of the cylindrical tube with speakers mounted on the surface, consistent with various embodiments.
Figure 4:
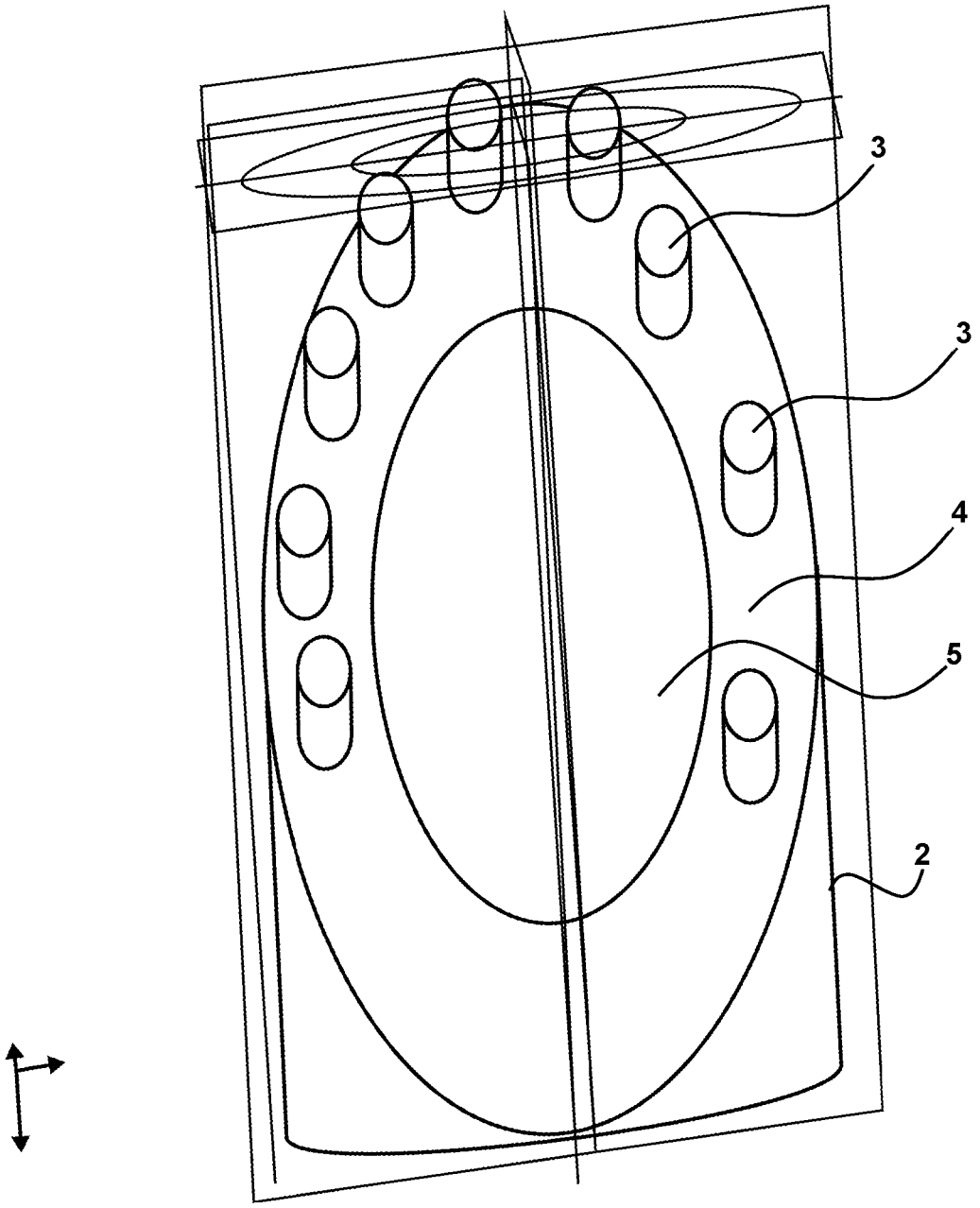
Figure 5:
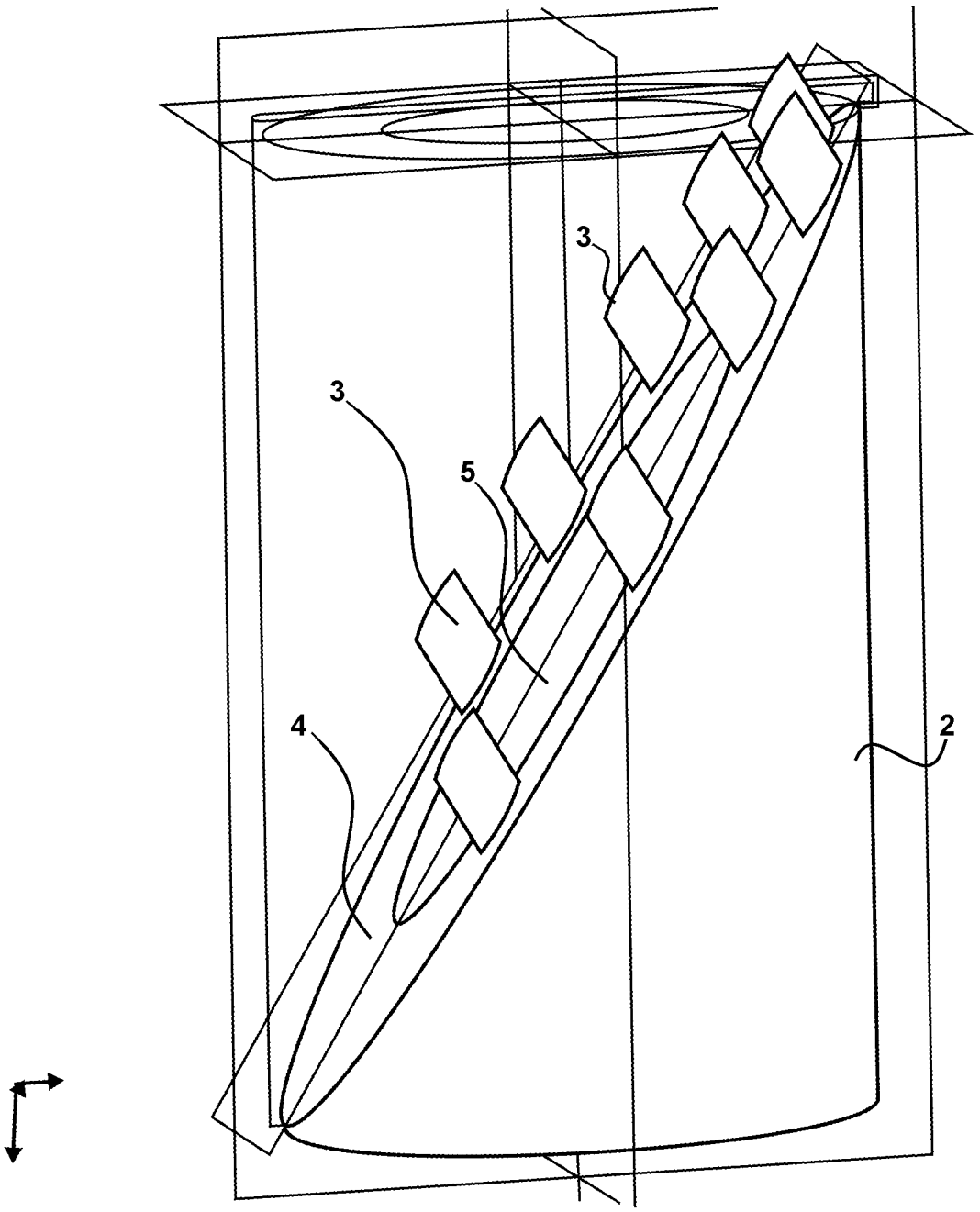
Figure 6:
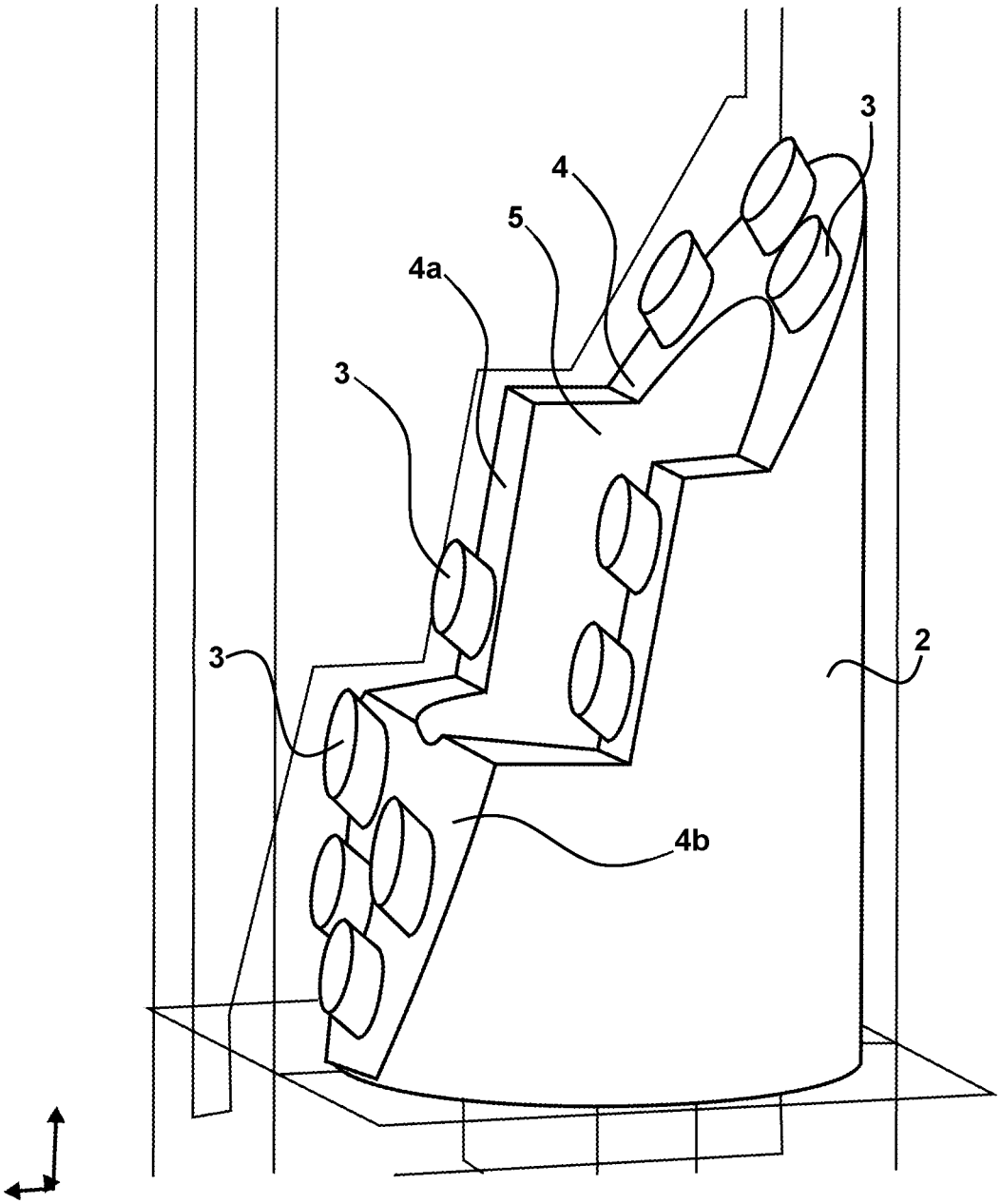
FIGS. 6, 7, 8 and 9 show various views of speaker arrangement on multiple surfaces of the cylindrical tube formed by cross sections created at various angles, consistent with various embodiments.
Figure 7:
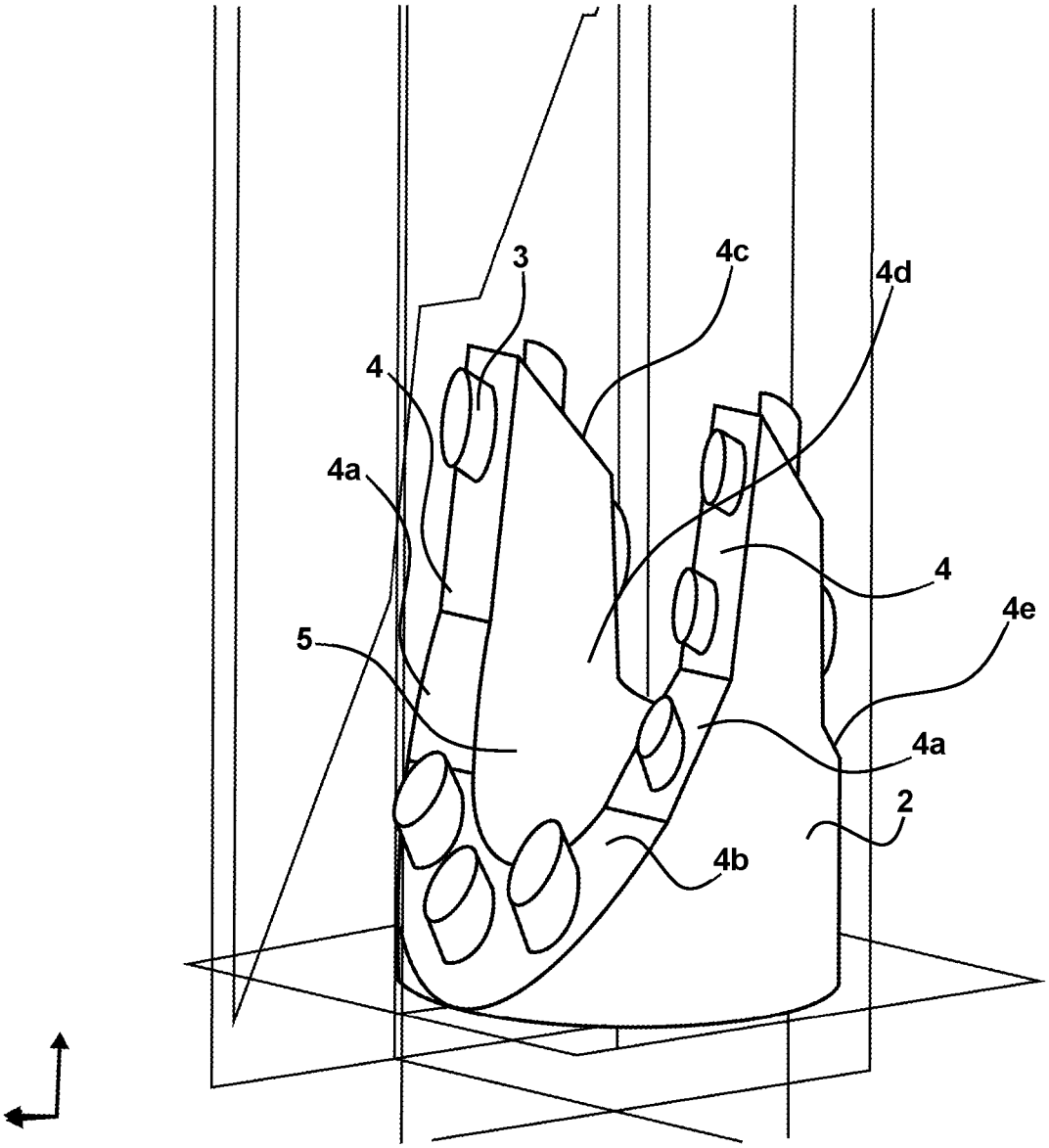
Figure 8:
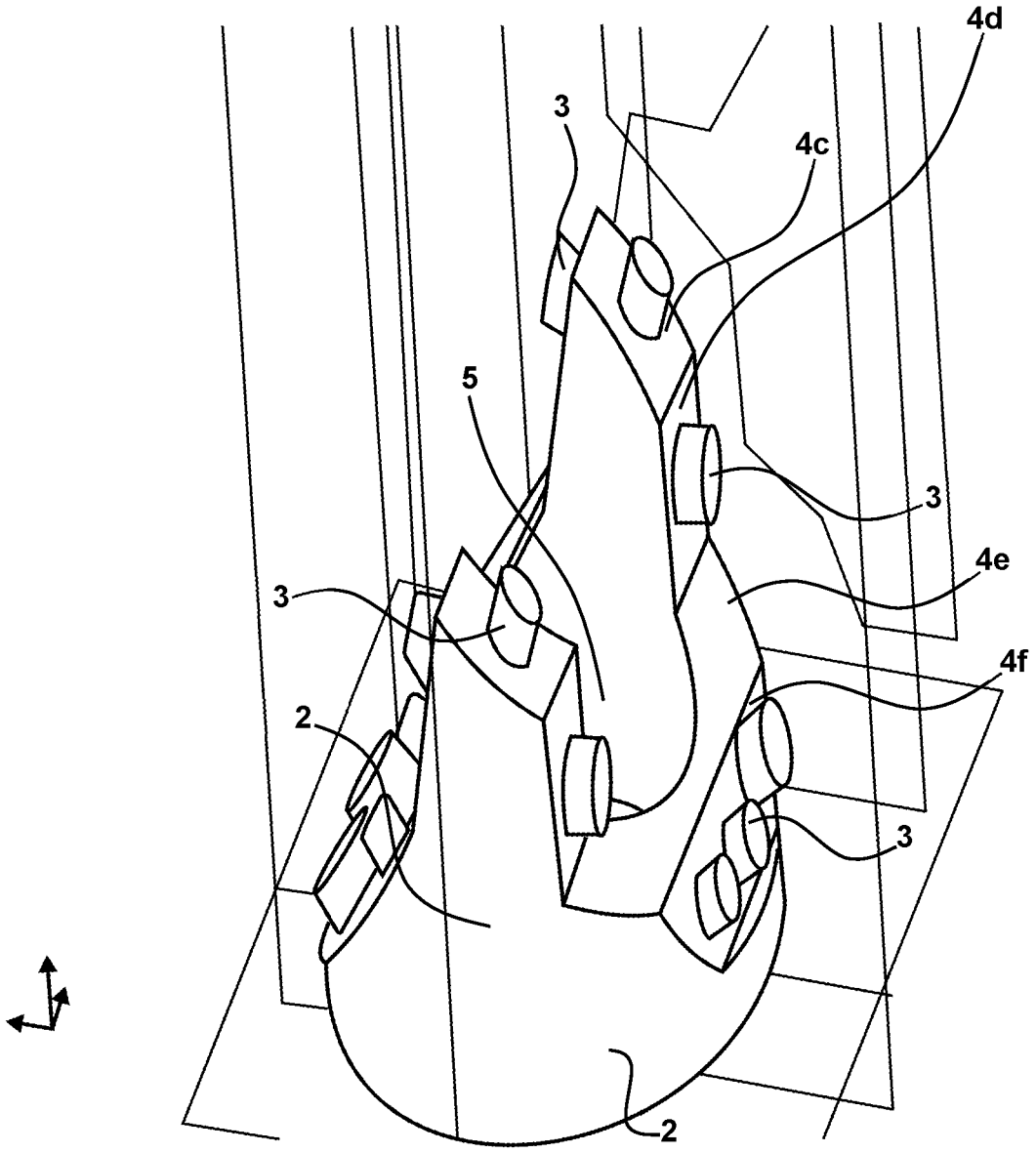
Figure 9:
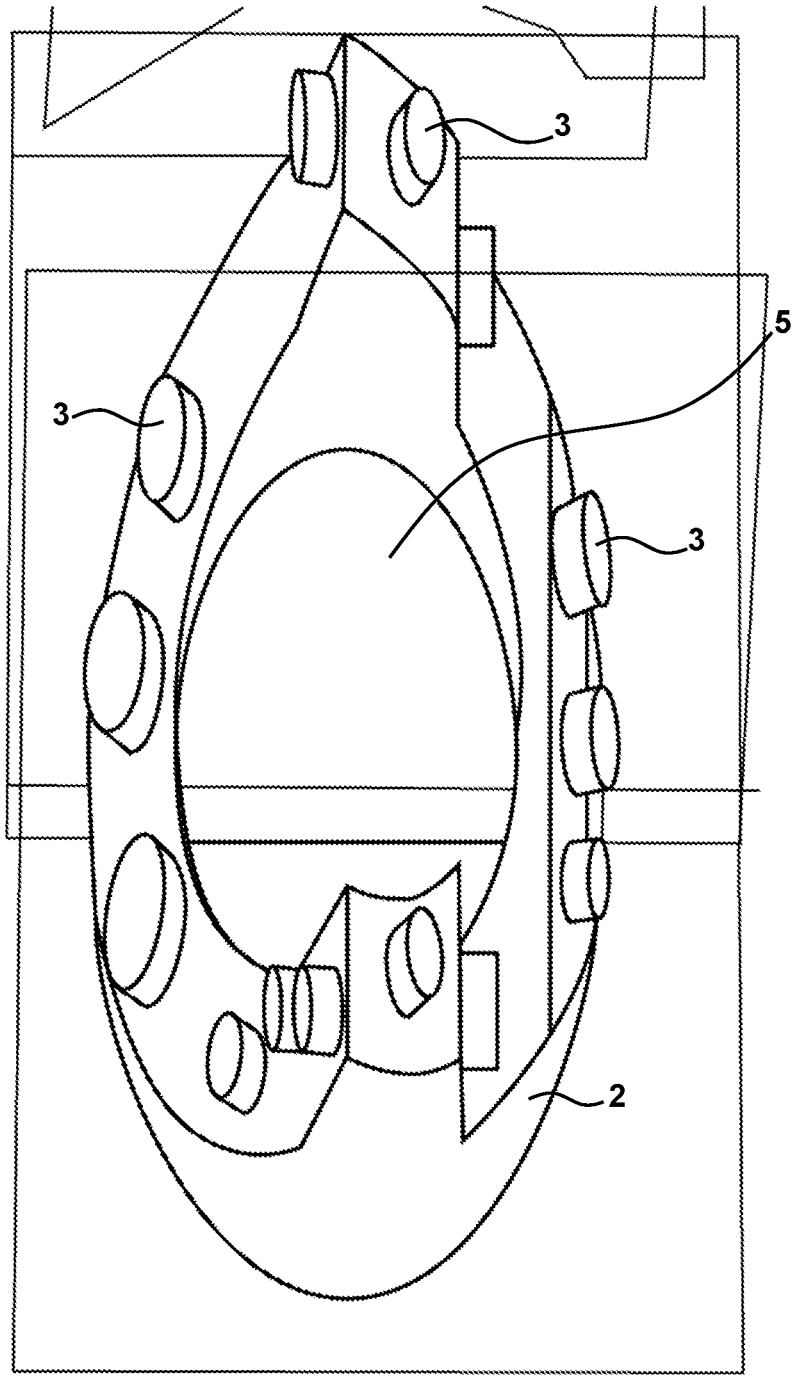

In some embodiments, the internal placement of speakers inside the cylindrical enclosure may be done by housing the speakers on an annular elliptical surface. Referring to FIG. 1, a cylindrical tube 2 sitting on the base 1 has an outer diameter and an inner diameter. The space 5 inside the cylindrical tube may be reserved for mounting a low frequency speaker called "subwoofer." As shown in FIG. 2, a cutting plane 7, removes a part of the tube 2, resulting in a view as illustrated in FIG. 3, which exposes the annular elliptical surface 4, on which medium-to-high frequency speakers denoted by 3, are mounted. Medium-to-high frequency speakers utilize a variety of new technologies to minimize speaker space and yet boost the sound volume output. FIGS. 4 and 5 illustrate N speakers being employed and placed around a single subwoofer. The cutting plane 7 can be used in a variety of angles repeatedly to create a generalized elliptical annular surface as shown in FIG. 6. In another generalization, the cutting plane 7 is used in two different opposite directions to create a construction as shown in FIGS. 7, 8 and 9.

Figure 10:
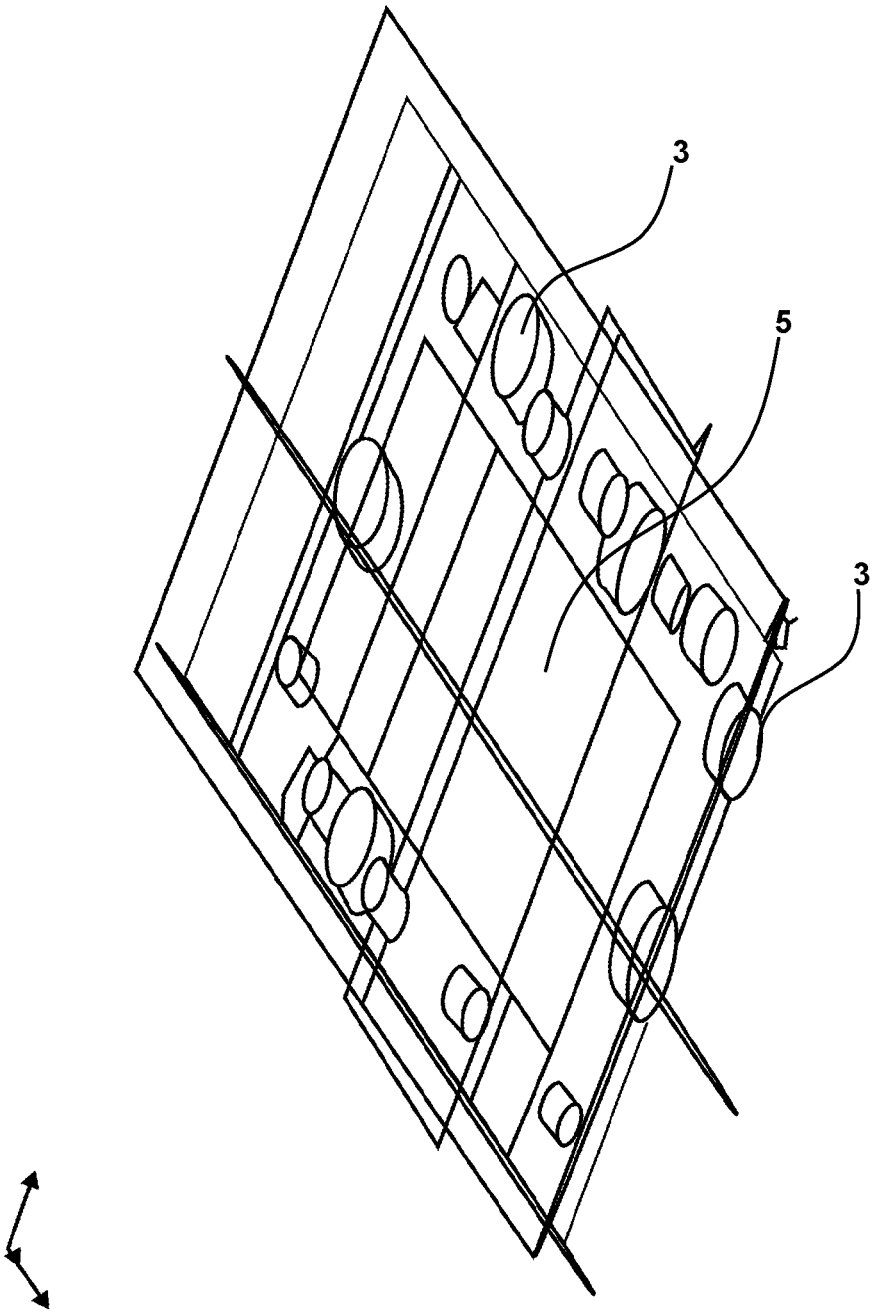
FIGS. 10 and 11 show speaker arrangement on multiple surfaces of a non-cylindrical tube, consistent with various embodiments.
Figure 11:
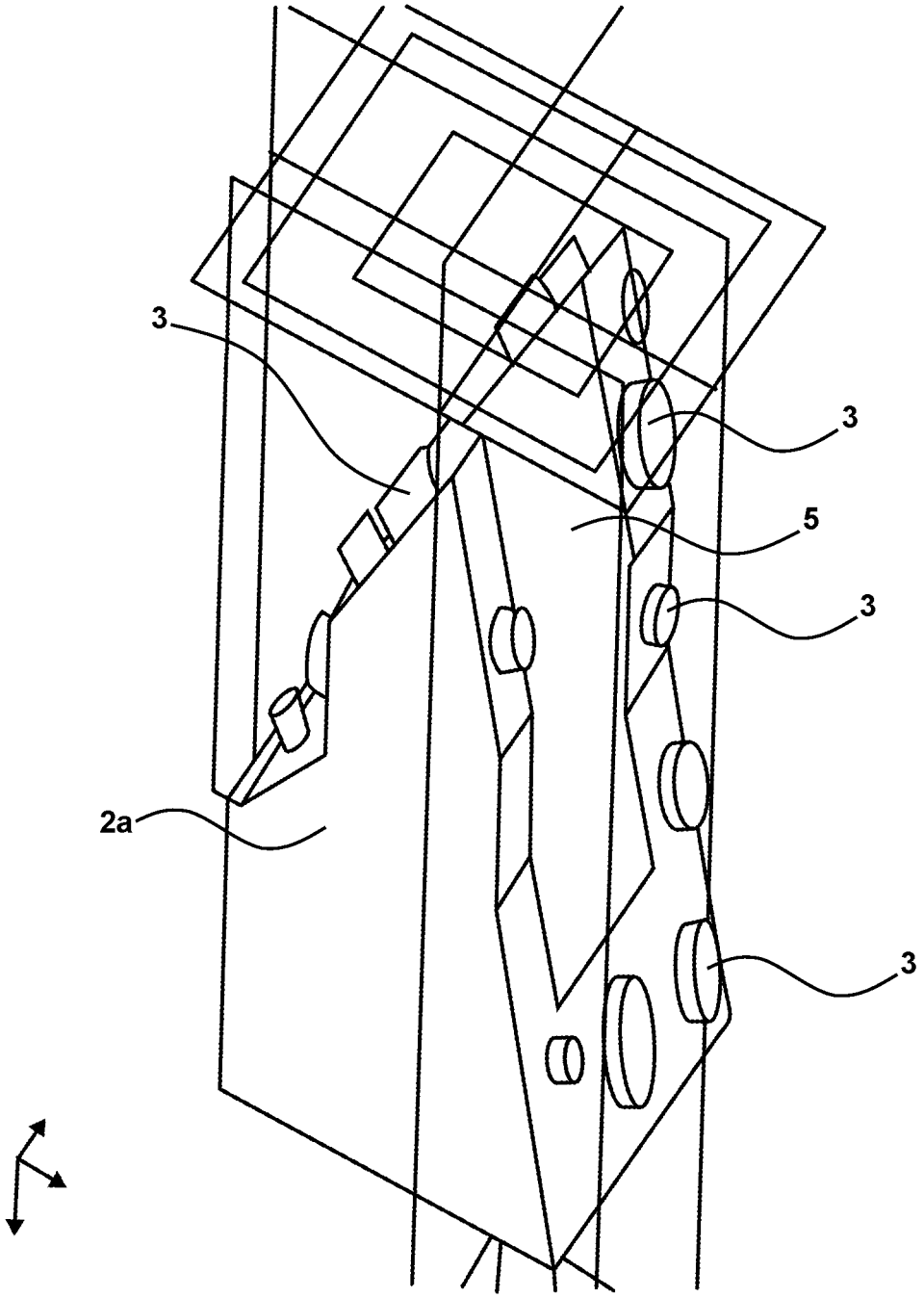
Figure 12:
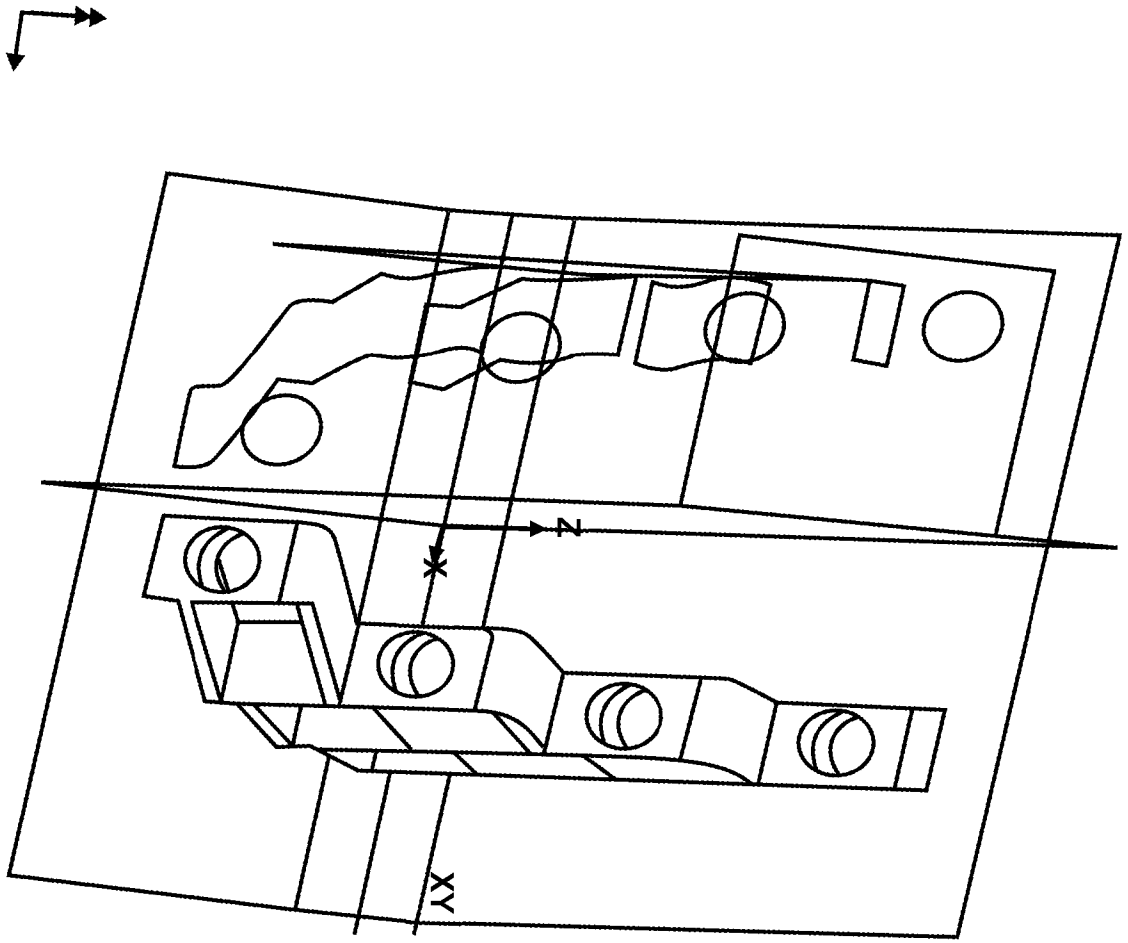
FIG. 12 shows a design of a speaker arrangement on annular elliptical surface, consistent with various embodiments.
Figure 13:
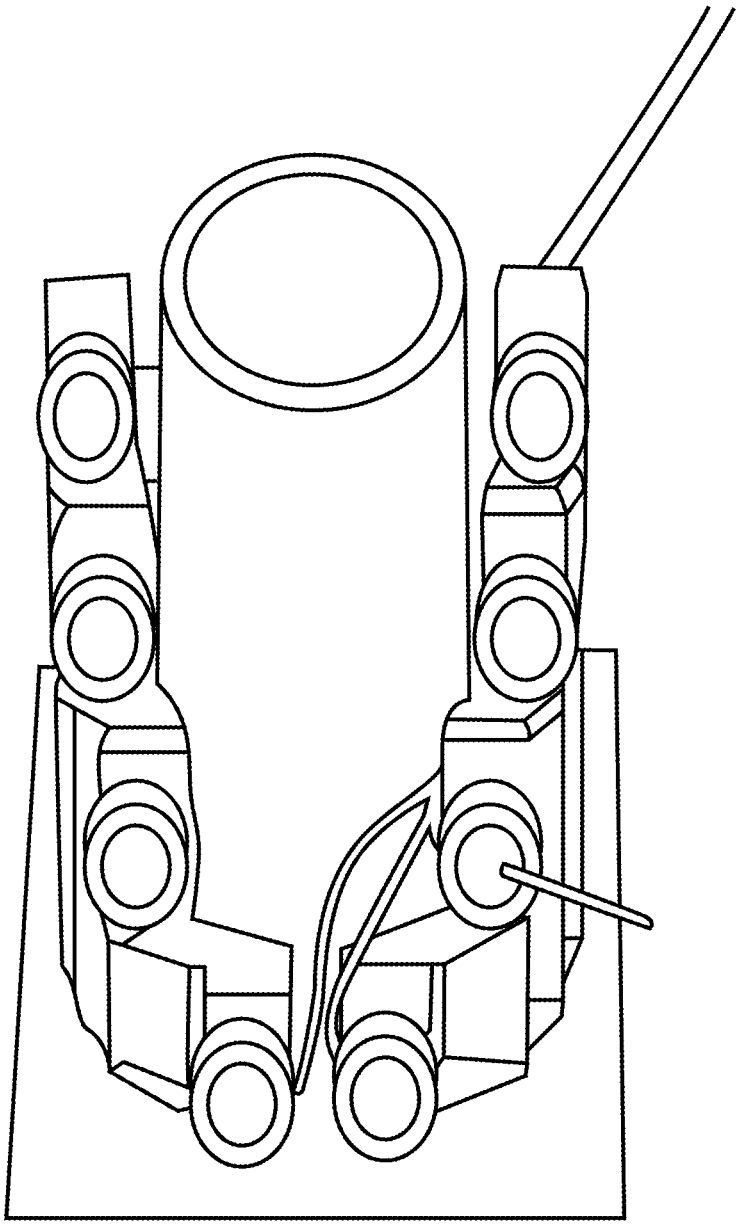
FIG. 13 shows an implementation of the speaker arrangement of FIG. 12, consistent with various embodiments.

While the foregoing embodiments illustrate the placement of speakers in a cylindrical tube, in other embodiments, the speakers can be placed in tubes of non-cylindrical shapes, e.g., rectangular tube. FIGS. 10 and 11 illustrate the placement of speakers in a rectangular tube. All these steps increase the degrees of freedom in the placement of speakers. Any tube with an arbitrary cross section having enough space to house a central subwoofer may also be used to construct the speaker array. FIG. 12 shows an example design of a speaker array to be enclosed in a tube with an arbitrary cross section. FIG. 13 shows an implementation of the design of the speaker array of FIG. 12. A large number of other designs may be possible for constructing the speaker array. The N speakers denoted by 3 are driven by N individual amplifier units. A separate amplifier is used to power the central subwoofer in the unit. Hence the capability of a single unit of this invention is denoted by (N:1) if only a single subwoofer is embedded in the unit. Depending on the size and requirements, it is easy to see that a larger unit containing a cluster of single units can handle (R:S), meaning R surround channels and S subwoofer channels.

Decoding Surround Sound Inputs

Surround sound stream is encoded digitally and is compressed with encoding technologies like for example, Dolby Atmos or DTS-X. The compressed stream is first demultiplexed to extract individual surround channels and decoded to obtain individual digital samples. If the total number of individual input sound channels is P comprising of S subwoofer and H height channels, then remaining (P-S-H) channels contain directional spatial sound. This arrangement is commonly denoted by [(P-S-H).S.H]. A height channel creates the impression of sound entering from the ceiling. These details are well known to a practitioner of this technology and will not be elaborated in this invention disclosure.

Speaker Enclosure to Enhance Performance

In a speaker system, an enclosure with a port (also known as a vented enclosure) is necessary to maximize the sound pressure from the speaker. Techniques used in such a design are well known to the designers in the field. Hence the placement of a speaker at a location in 3D space also includes its ported enclosure. Again, details are omitted here. Another possibility is to employ a set of passive radiators to boost the low frequency response.

Subwoofer Integration

Placement and installing subwoofer in the center of annular space requires special considerations to allow both high frequency and low frequency vibrations from speakers and the subwoofer exist without restricting or interfering with each other. The engineering design is well known to the practitioners of the art.

Signal Processing for Surround Sound

1. Energy Equalization at a Set of Distant Points—Multi-Channel Multi-Beam Forming Let the 3D coordinates of all N speakers be given by $$S^{xyx} = \begin{bmatrix} x_1 y_1 z_1 \\ x_2 y_2 z_2 \\ x_3 y_3 z_3 \\ \vdots \\ x_N y_N z_N \end{bmatrix}$$

where $(x_i y_i z_i)$ is the coordinates of the i-th speaker. In general, all speakers occupy different 3D locations.

Let there be a set of distant points $\{F^i\}$ with coordinates $\{f_x^i f_y^i f_z^i\}$ for i=1, 2, 3, . . . P where we want to maximize the audio energy by bringing all the speaker outputs in phase so as to add up to a maximum energy level. The necessary condition for this to happen is to find a set of integers $\{d_1^i, d_2^i, d_3^i, \ldots d_N^i\}$ and short M-length filters $\{h_1^i, h_2^i, h_3^i, \ldots h_N^i\}$ such that the input signal to the speakers from the i-th surround input $\{x^i[k]\}$ for i=1, 2, 3, . . . P and k=0, 1, 2, 3 . . . is generated in the following way:

$$y_n^i[k] = \sum_{m=0}^{M-1} h_n^i[m] x^i[k - d_n^i - m] \text{ for } i = 1, 2, 3, \ldots, P; \quad (1)$$

$$n = 1, 2, 3, \ldots N; k = 0, 1, 2, 3 \ldots$$

which means that the n-th speaker receives the signal:

$$y_n[k] = \sum_{i=1}^{P} y_n^i[k] = \sum_{i=1}^{P} \sum_{m=0}^{M-1} h_n^i[m] x^i[k - d_n^i - m] \quad (2)$$

The solution $\{d_1^i, d_2^i, d_3^i, \ldots d_N^i\}$ is obtained by computing the Euclidian distance between $S^{xyx}$ and $\{F^i\}$ and making the distances equal with the constraint that the set $\{d_1^i, d_2^i, d_3^i, \ldots d_N^i\}$ must contain only positive integers. The M-length filters $\{h_1^i, h_2^i, h_3^i, \ldots h_N^i\}$ are chosen to make phase angle continuities are maintained while preserving wide bandwidth needed. This means that given the speaker positions $S^{xyx}$ and $\{F^i\}$, P×N table containing $\{d_1^i, d_2^i, d_3^i, \ldots d_N^i\}$ and M×N×P table containing $\{h_1^i, h_2^i, h_3^i, \ldots h_N^i\}$ can be precomputed and stored in the memory. As the samples from each input channel arrive, the equation (2) is implemented as a matrix filter operation. The implementation of (2) is a well-known art in the discipline of digital signal processing with a FPGA or a custom ASIC.

2. Codebook Generation of $\{F^i\}$ for Sound Panorama

Figure 14:
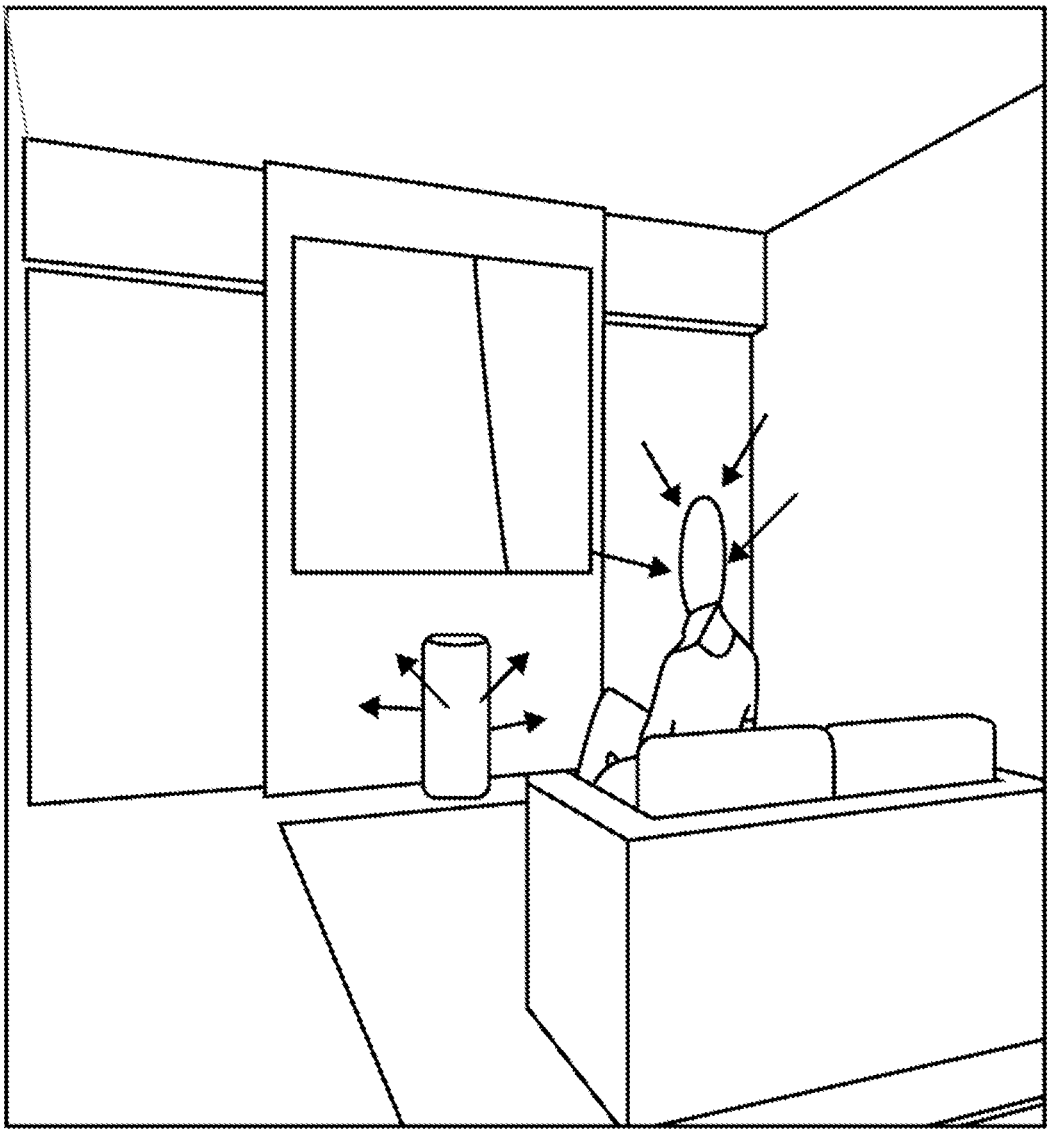
FIG. 14 shows a placement of a cylindrical speaker array in a room, consistent with various embodiments.

As shown in FIG. 14, the directional vectors associated with the surround sound inputs (shown by red arrows around a human) is not the same as the ones generated (shown by blue arrows around the speaker array) at the speaker array. Most of the living rooms are designed differently to suit the preferences of the homeowner. Though it is possible to obtain the blueprints of the living room, or conduct a 3D scanning with real-time devices currently available in the market (See [8]), and computing exact wave propagation using Finite-Time-Finite-Difference (FTFD) simulation (see [10]), a simpler and faster possibility exists with adaptive rectangular approximations as detailed in [7]. With rectangular decomposition of the living room, the first order decomposition is the dominant one. The living room is approximated as a rectangular box with possibly some non-reflecting openings and sound absorbing surfaces like, for example, curtains.

Figure 15:
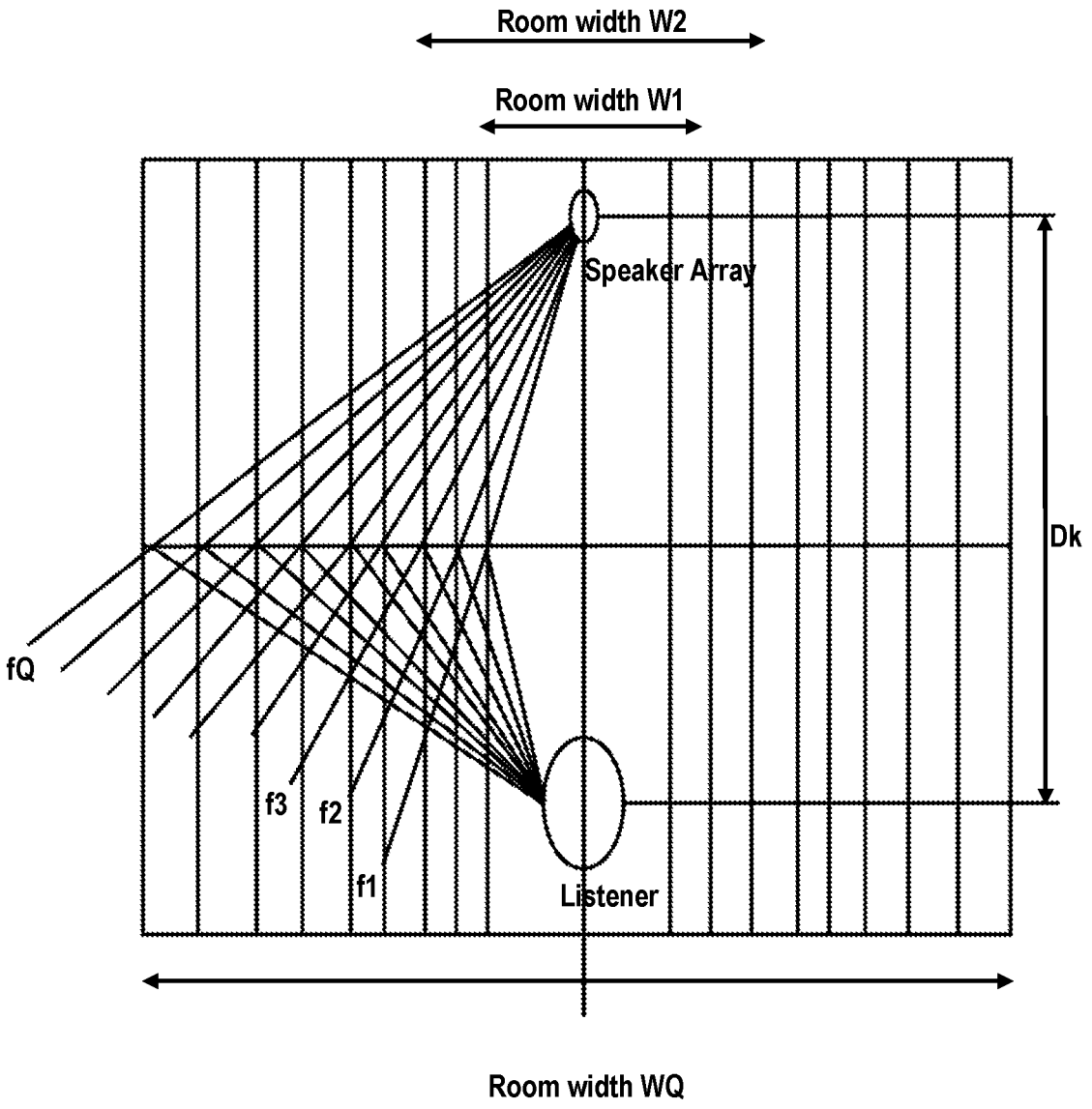
FIGS. 15 and 16 show codebook generation for a specific surround input in horizontal plane, consistent with various embodiments.
Figure 16:
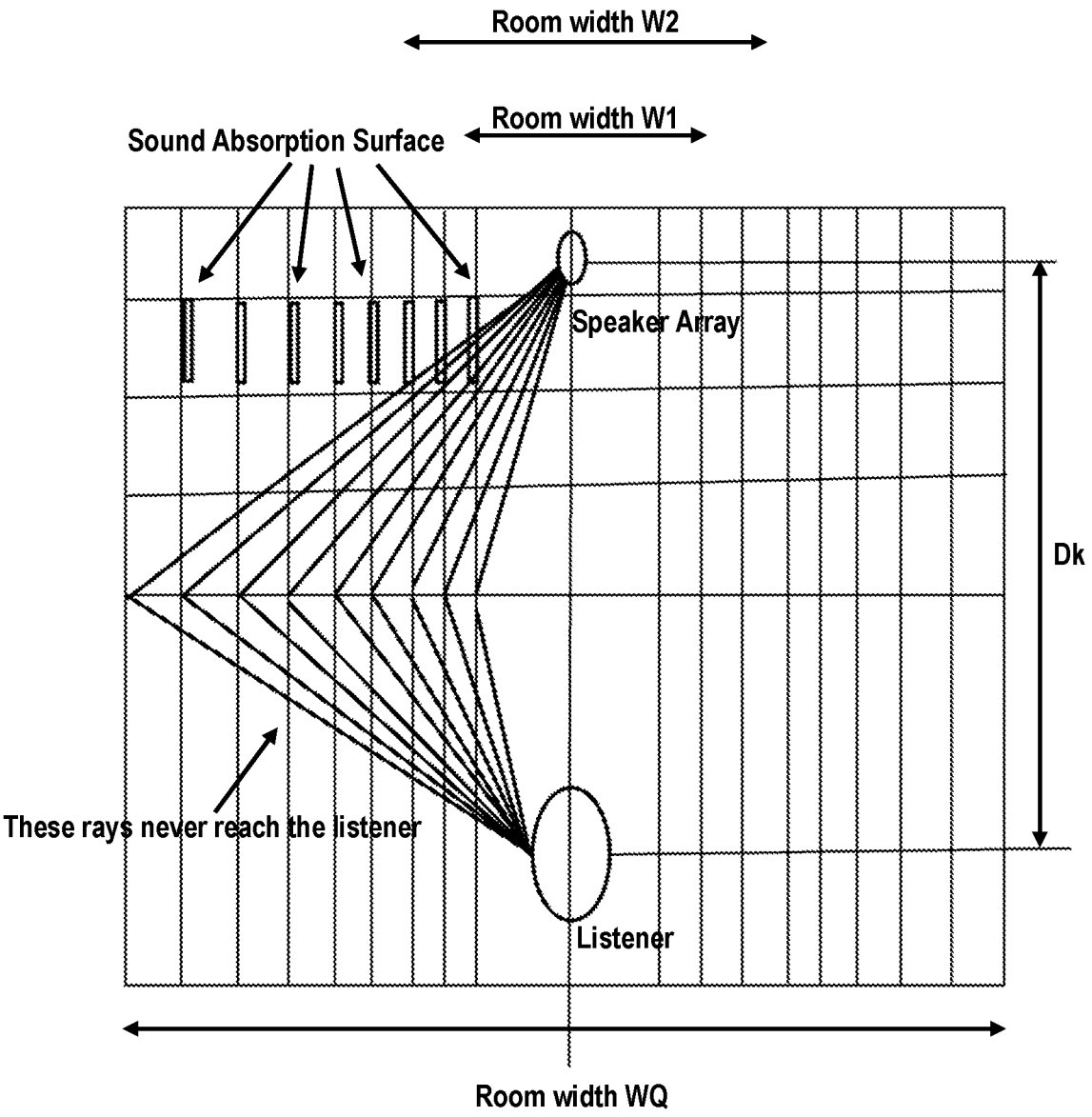

FIG. 15 shows the top view of the living room with the soundbar and the listener at a distance of $D_k$ from each other, chosen from a list of $\{D_1, D_2, D_3, \ldots D_L\}$. The room width is varied from $\{W_1, W_2, W_3, \ldots W_Q\}$. For each combination of listener-to-soundbar distance and room width, ray tracing is done with rays emanating from the soundbar and reaching the listener as the room width is varied. Each successful ray is an entry in the codebook of size $W_Q \times D_L$ and specifies a point $F^i$ or a directional vector $f_i$ if the soundbar location is considered as the origin, shown in FIG. 15 as dotted lines. Notice that even in the case of obstructions, openings, and other sound absorbing surfaces, the codebook generated will yield useful solutions as shown in FIG. 16. Some of the generated would be lost because of obstructions but it is easy to find at least one directional vector in a practical situation. FIGS. 15 and 16 illustrate the codebook generation for a specific surround input in horizontal plane. Extending to P inputs, the codebook must have $W_Q \times D_L \times P$ directional vectors to aid the soundbar sending the acoustic wave front in the intended direction.

3. Psycho-Acoustic Benefits

The above strategy of using rectangular decompositions of living room geometry has the benefit of accentuating the "first wavefront", (see the discussion in section 3.4 of [7]) to reinforce the perception of directional sound, (see chapter 5.4 in [13]). In addition, the process of generating surround signals in either Dolby Atmos or DTS-X exaggerates the directional information to catch the attention of the listener. The "late reverberations" arising due to geometry of the living room also are helpful in "tuning-in" to the directionality of the surround sound. As a result of these additive reinforcements, the sound rendered from the array is heard as clearly directional.

4. Speaker Equalization

In order to control the frequency spectral properties of the speakers, multi-band equalization is employed. A bi-quad IIR filter is described by z-domain the transfer function $$H_i(z) = K_i \frac{b_{io} + b_{i1}z^{-1} + b_{i2}z^{-2}}{a_{io} + a_{1i}z^{-1} + a_{i2}z^{-2}} \quad (3)$$

A cascade of B such filters constitutes a combined transfer function of $$H(z)=\Pi_{i=1}^{B} H_i(z) \quad (4)$$

and is useful for making frequency spectrum even and pleasant for human ears. The digital implementation of these cascaded filters is a well-known prior art, see [14], [15], and [16]. The tuning of filters is done by a graphical user interface that controls the spectral bands by adjusting the bi-quad filter coefficients.

5. Digital Implementation of the Entire System with a FPGA

A Field Programmable Gate Array (FPGA) contains a collection of complex logic blocks that be rearranged as multipliers, adders, logic gates, memories, and other higher order functional blocks in a vendor-supplied library. Depending on the vendors—Xilinx, Altera (now owned by Intel), Actel, and Lattice—different adjustments and restructuring of synthesis code written in either Verilog or VHDL is necessary. The art and science of implementation with FPGA is readily available in [14]. The aim in design is to recast divisions as multiplications and additions and (re)use the multipliers. Another consideration is timing synchronization between different branches of the solution. FPGA implementation helps in the path towards building a custom ASIC. The digital design described here is done for at least three different family of FPGAs and verified for functionality.

Figure 20:
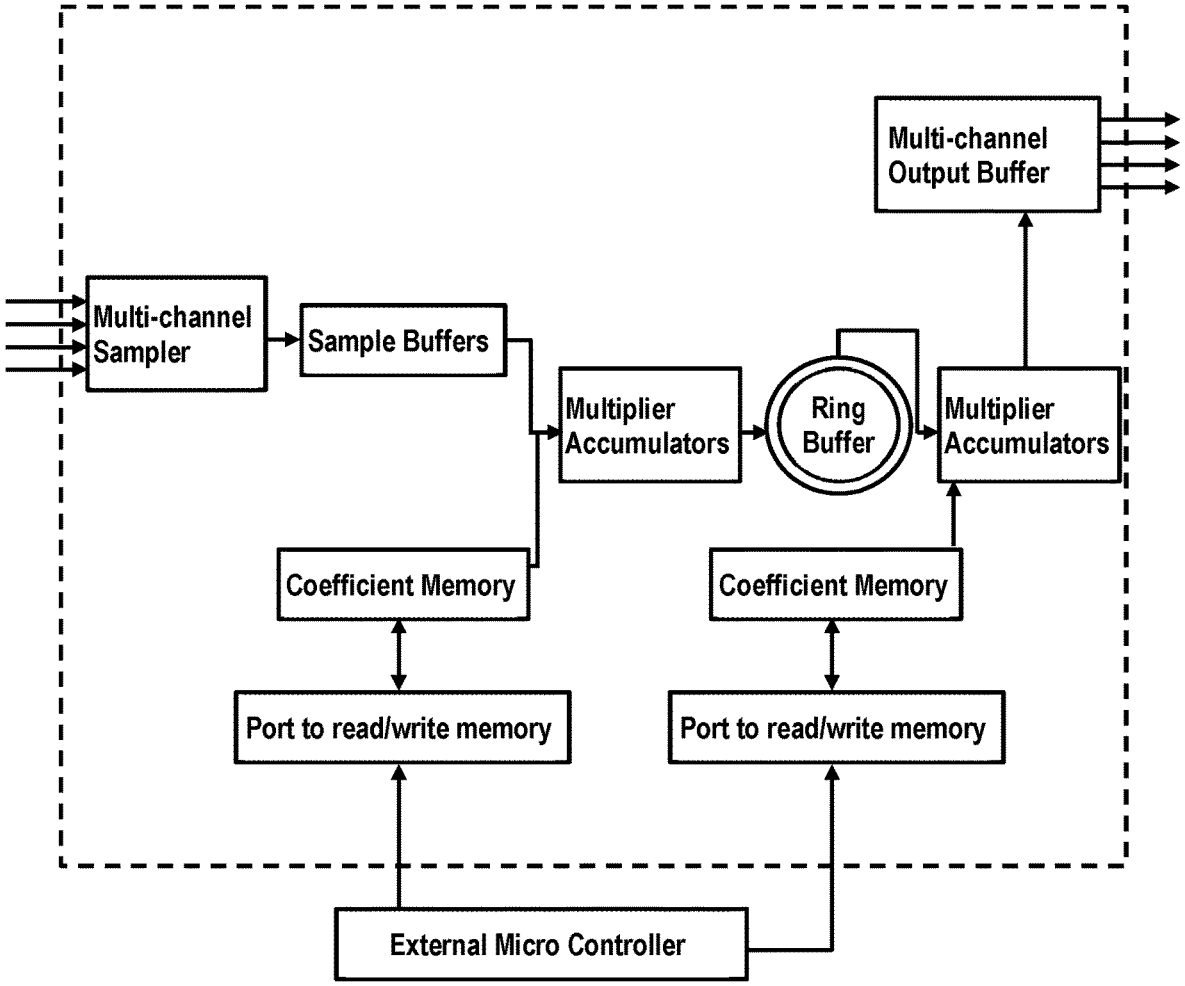
FIG. 20 shows a block diagram of Field Programmable Gate Array (FPGA) implementation for processing the sound to be output by the speaker array, consistent with various embodiments.

FIG. 20 shows the main block diagram of our FPGA implementation which is only one of the several possibilities of an implementation. All the functionalities are reduced or reformulated as storing the input signal in a buffer (either linear or ring buffer) and employing Multiply-Accumulate (MAC) blocks of the FPGA to generate the output signals which are further amplified and sent to speakers. Several coefficient storage units are used to store coefficients in an efficient manner to control the output generation. These coefficients are fed through a serial or parallel port by a microcontroller or a Linux system such as Raspberry Pi, [27], or a Windows/Mac personal computer. Microcontroller or Raspberry Pi or Windows/Mac Systems can also be used to generate the coefficients with modeling software and can drive motion platform to be described next.

Swarm Speaker Arrays

Figure 18:
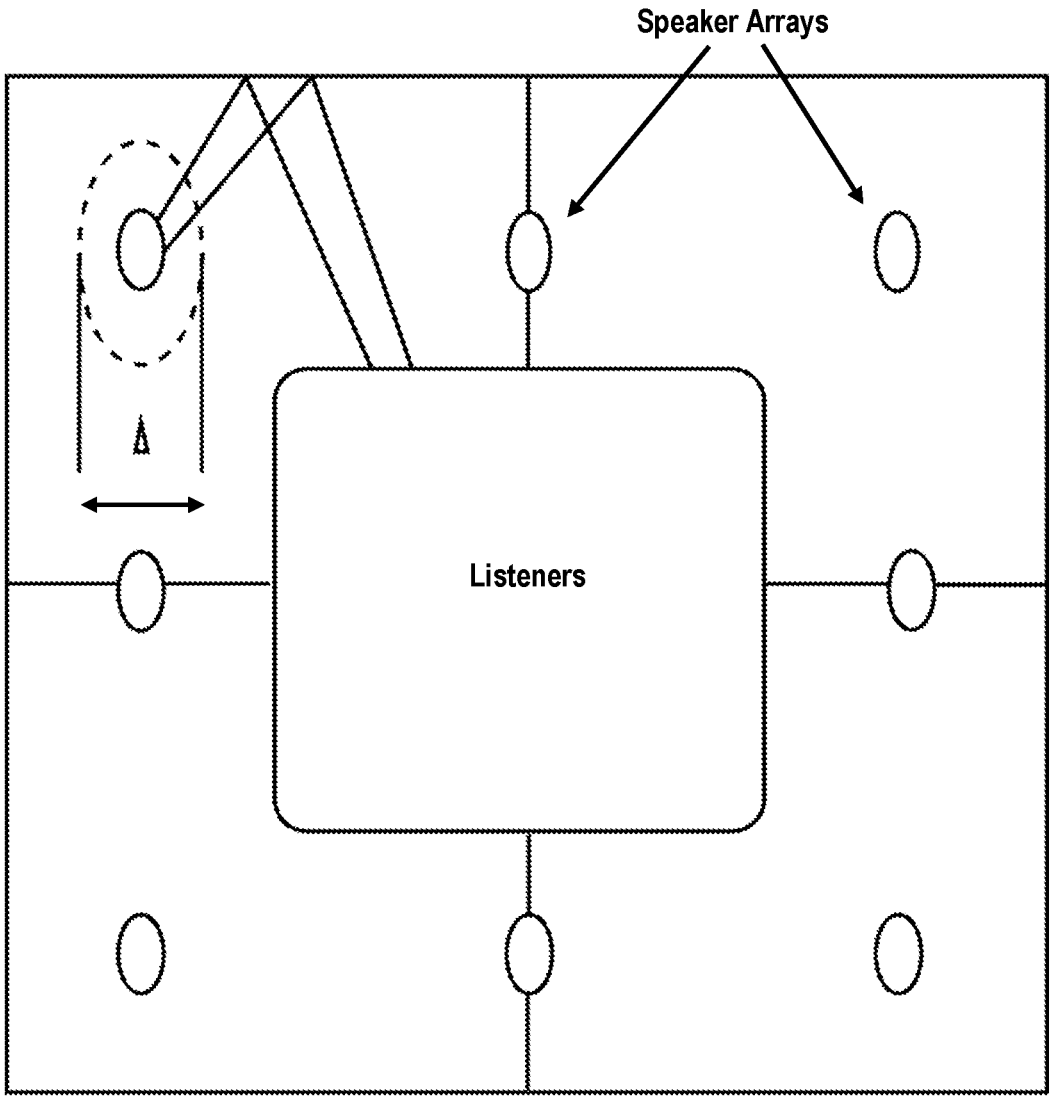
Figure 19:
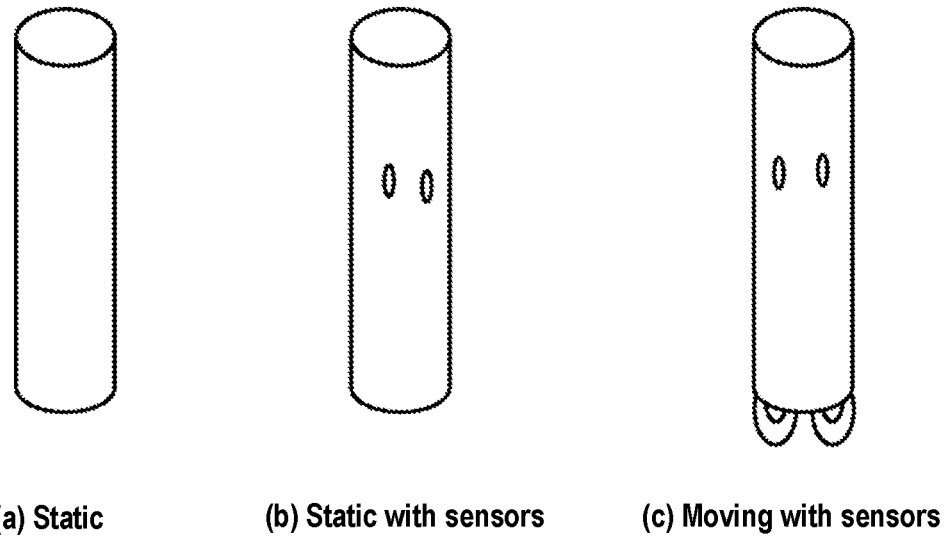
FIG. 19 shows different types of speaker arrays, consistent with various embodiments.

A swarm of speaker arrays includes a number of speaker arrays, as illustrated in FIG. 18. The speaker arrays in the swarm can be interconnected, can be coordinated to reinforce the surround sound experience. The swarm of speaker arrays can maximize hearing experience by tracking the listener position. Each of the speaker arrays may be repositioned or reoriented based on listener position. Swarm of speaker arrays can be static, use sensors to measure 3D geometry, and be on a robotic motion platform. As shown in FIG. 19, speaker arrays can be fixed statically to a location, or have sensors to make measurements on the surrounding 3D space. The third option is to have a robotic motion platform and house the speaker array on the motion platform. The first operation is to get a 3D map of the listening room with a stereoscopic depth measurement or with a sensor such as mentioned in [8]. Another option is to use a lidar sensor, see [18], [19], or an ultrasound distance sensor such as sold by [28]. Yet another possibility is to employ a sequence of overlapping photographs of the listening room or a slow movement video sequence to extract the three-dimensional geometry of the living room with photogrammetry software such as [21] or as described in [22]. The engineering effort involved is well understood by a practitioner of the art.

Figure 17:
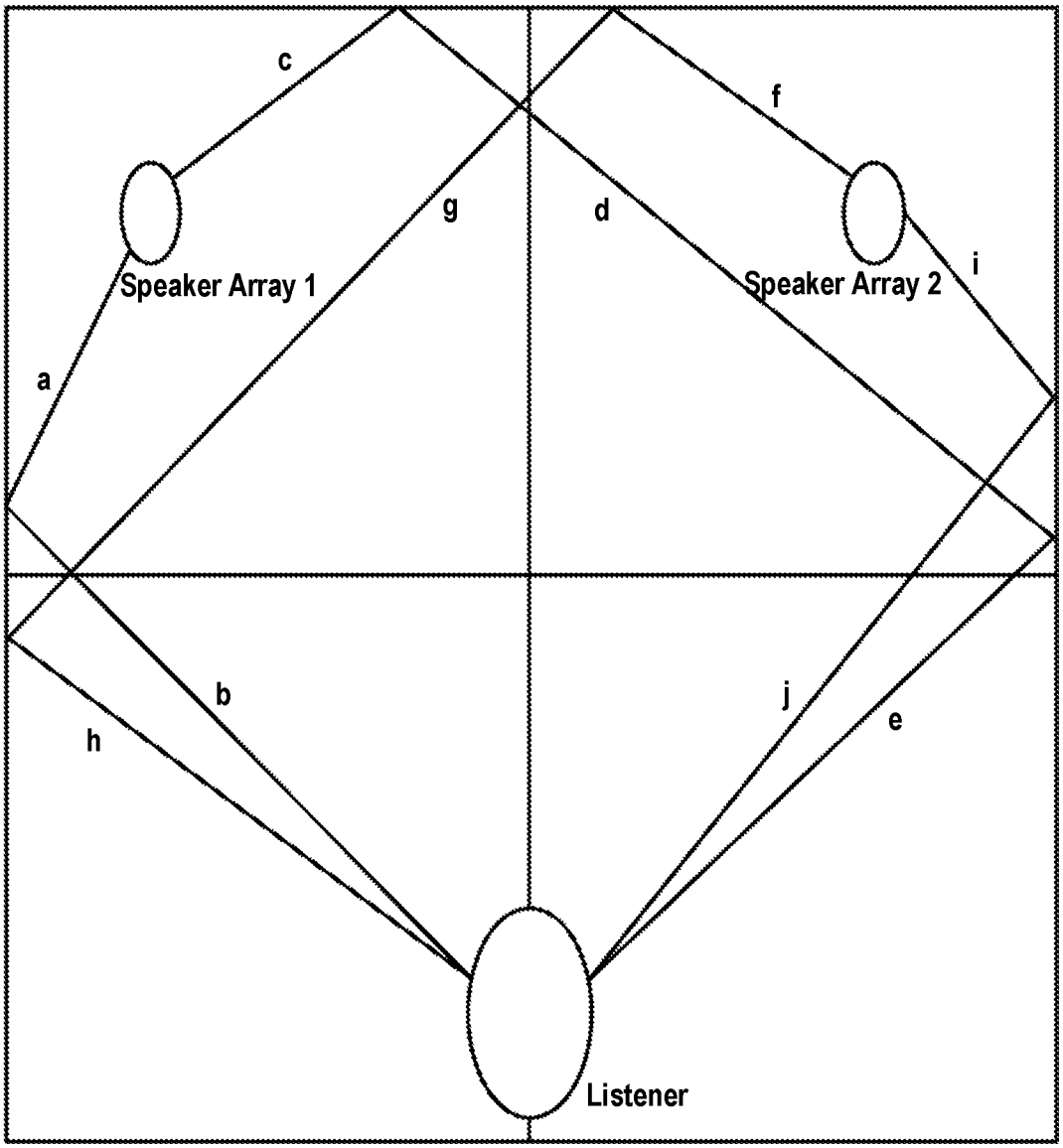
FIGS. 17 and 18 show distribution of sound rays when multiple interconnected speaker arrays are placed in a room, consistent with various embodiments.

Once the 3D map of the environment is obtained, as shown FIG. 17, speaker array 1 can compute the directional vector using the ray a-b (to reach the left side of the listener) or ray c-d-e (to the right side of the listener). Similarly, speaker 2 can use the directional vector corresponding to ray f-g-h or the ray i-j. A number of well-known techniques can be used to simulate the wave propagation of sound, as described in [23], or by using software packages such as i-Simpa,[24], EASE,[25], or 3D Finite Difference Time Domain (FDTD) pressure wave solvers, FDAC3DMOD, [26].

Extending to a large number of speaker arrays, as shown in FIG. 18, can provide excellent sound coverage in a large listening space. The coordination and control of movements is readily adapted from the work done in the area of swarm robotics, see [17], [20]. Each member of the swarm can execute a set of simple tasks such as (a) measure 3D space in the vicinity (2) compute directional vectors (3) select the input surround channel which is compatible with direct and reflected rays (4) have limited projection capability and yet provide big sound by coordinating with other speaker arrays.

Since a single member of swarm speaker array, as shown in FIG. 18, contributes a single or small number of input channels, a small search area of diameter "a" can be used to "finetune" the placement of this single member of the swarm so that the signal reaches the listeners at the target area. This can be done sequentially for each member of the swarm with a feedback information from the listener target area. This finetuning is needed in complex listening environments where geometry measurements are inaccurate or sound absorption and diffraction exist. An alternate strategy would be to perturb all the members of the swarm simultaneously with a gradient search optimization which will maximize the signal power at the listening target area.

Conversely if the listener occupancy map in 2-D space is available, the swarm can be made to track the areas where listeners sit. A contact switch can be placed in every seat of the listening room to transmit a binary signal to indicate if the seat is occupied or not. With this binary occupancy map, the swarm can reorient to provide the best possible over all listening experience to all present in the listening room. The algorithms needed to implement automatic tracking of listener positions are readily available to any practitioner of the art using the formulation of maximization of overall signal level in the room. With swarms with motion capability this can be done in almost real-time. Listener position tracking can also be done using cameras. In some embodiments, as the listener position changes, the speaker arrays may automatically change their position or orientation to provide the best possible over all listening experience to the listener.

The swarm speaker array may be configured to control positioning (e.g., including orientation) of a speaker array in the swarm. For example, a speaker array in the swarm may be mounted on a motion-controlled platform that can be controlled to move the speaker array to adjust the position. Various motion-controlled platforms can be implemented. For example, the motion-controlled platform can be implemented as robotic platform with wheels as illustrated in FIG. 19. In another example, the motion-controlled platform can be implemented as an aerial platform that lifts the speaker array in air. In another example, the motion-controller platform can be a drone that enables the speaker array to fly. In another example, the motion-controlled platform can be a tethered platform in which the speaker array is tethered to a support (e.g., a cable) that can be controlled to facilitate the movement of the speaker array. The speaker arrays may be controlled using a centralized control system that is configured to control any of the speaker arrays in the swarm. The speaker arrays may be controlled autonomously (e.g., independently—the positioning of a speaker array is controlled by itself). In some embodiments, some of the speaker arrays may be controlled by the centralized control system and some autonomously.

A few features of the speaker array include:

1. The speaker array provides a small footprint and can be placed on the floor similar to a subwoofer.
2. It provides great surround sound rendering with surround sound input signals from Dolby Atmos, DTS-X, or Dolby Digital 5.1, 6.1, stereo formats in the physical space of living room.
3. To cover a larger space like a theater, many units can be placed on the floor, interconnected, and operated.
4. Multi-channel input sources can be multiplexed and rendered as a sound panorama in 3D space.
5. The cost of the speaker array is comparable to a conventional home theater sound bar.
6. General 3D solution presented here may apply to linear array (speakers placed on a straight line) or matrix array (speakers placed on a two-dimensional grid).
7. The speaker array is housed in a cylindrical enclosure which can be static, or with space measurement sensors or housed in a motion-controlled platform.
8. Multiple speaker arrays (swarm) can be coordinated to reinforce the surround sound experience.
9. The digital signal processing can be implemented with cost effective FPGA or a custom ASIC.
10. Adaptive and intelligent theaters and large listening rooms may be constructed with swarm of speaker arrays which can maximize hearing experience by tracking the listener position.
11. Swarm of speaker arrays can be static, use sensors to measure 3D geometry, and be on a robotic motion platform. With a combination of fixed and moving speaker arrays, a large listening space can be made to adapt to the listeners in the room. This avoids wasting signal power in places where there is no listener present.

In some embodiments, the various embodiments described herein may use one or more computing devices that are programmed to perform the functions described herein. The computing devices may include one or more electronic storages, or other electronic storages), one or more physical processors programmed with one or more computer program instructions, and/or other components. The computing devices may include communication lines or ports to enable the exchange of information within a network or other computing platforms via wired or wireless techniques (e.g., Ethernet, fiber optics, coaxial cable, Wi-Fi, Bluetooth, near field communication, or other technologies). The computing devices may include a plurality of hardware, software, and/or firmware components operating together. For example, the computing devices may be implemented by a cloud of computing platforms operating together as the computing devices.

The electronic storages may include non-transitory storage media that electronically stores information. The storage media of the electronic storages may include one or both of (i) system storage that is provided integrally (e.g., substantially non-removable) with servers or client devices or (ii) removable storage that is removably connectable to the servers or client devices via, for example, a port (e.g., a USB port, a firewire port, etc.) or a drive (e.g., a disk drive, etc.). The electronic storages may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The electronic storages may include one or more virtual storage resources (e.g., cloud storage, a virtual private network, and/or other virtual storage resources). The electronic storage may store software algorithms, information determined by the processors, information obtained from servers, information obtained from client devices, or other information that enables the functionality as described herein.

The processors may be programmed to provide information processing capabilities in the computing devices. As such, the processors may include one or more of a digital processor, an analog processor, a digital circuit designed to process information, an analog circuit designed to process information, a state machine, and/or other mechanisms for electronically processing information. In some embodiments, the processors may include a plurality of processing units. These processing units may be physically located within the same device, or the processors may represent processing functionality of a plurality of devices operating in coordination. The processors may be programmed to execute computer program instructions to perform functions described herein. The processors may be programmed to execute computer program instructions by software; hardware; firmware; some combination of software, hardware, or firmware; and/or other mechanisms for configuring processing capabilities on the processors.

Remarks

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments. Accordingly, the embodiments are not limited except as by the appended claims.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Terms that are used to describe the disclosure are discussed below, or elsewhere in the specification, to provide additional guidance to the practitioner regarding the description of the disclosure. For convenience, some terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way. One will recognize that "memory" is one form of a "storage" and that the terms may on occasion be used interchangeably.

Consequently, alternative language and synonyms may be used for any one or more of the terms discussed herein, nor is any special significance to be placed upon whether or not a term is elaborated or discussed herein. Synonyms for some terms are provided. A recital of one or more synonyms does not exclude the use of other synonyms. The use of examples anywhere in this specification including examples of any term discussed herein is illustrative only, and is not intended to further limit the scope and meaning of the disclosure or of any exemplified term. Likewise, the disclosure is not limited to various embodiments given in this specification.

Those skilled in the art will appreciate that the logic illustrated in each of the flow diagrams discussed above, may be altered in various ways. For example, the order of the logic may be rearranged, substeps may be performed in parallel, illustrated logic may be omitted; other logic may be included, etc.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions will control.

REFERENCES

[1] Barry D Van Veen and Kevin M. Buckley, "Beamforming: A Versatile Approach to Spatial Filtering", page 4-24, IEEE ASSP Magazine, April, 1988, Vol. 5, Number 2.

[2] Harry L. Van Trees, "Optimum Array Processing" Part IV of Detection, Estimation, and Modulation Theory, Wiley Inter science, New York

[3] https://www.dolby.com/in/en/brands/dolby-atmos.html

[4] https://dts.com/at-home

[5] Kenichi Kumatani, John McDonough, and Bhiksha Raj, "Microphone Array Processing for Distant Speech Recognition", page 127-140, IEEE Signal Processing Magazine, November 2012

[6] Bruno de Silva, An Bracken, Kris Steenhaut, and Abdellah Touhafi, "Design Considerations When Accelerating an FPGA-Based Digital Microphone Array for Sound Source Localization", Hindawi, Journal of Science, Volume 2017, Article ID 6782176, 20 pages

[7] Nikunj Raghuvanshi, Rahul Narain, and Ming C. Lin, "Efficient and Accurate Sound Propagation Using Adaptive Rectangular Decomposition", IEEE Transactions on Visualization and Computer Graphics, volume 15, number 5, September/October 2009, pages 789-801

[8] https://structure.io/

[9] J. B. Allen and D. A. Berkley, "Image Method for Efficiently Simulating Small-Room Acoustics," J. Acoustical Soc. Am., vol. 65, no. 4, pp. 943-950, 1979

[10] D. Botteldooren, "Finite-Difference Time-Domain Simulation of Low-Frequency Room Acoustic Problems," J. Acoustical Soc. Am., vol. 98, pp. 3302-3308, December 1995.

[11] https://www.epcc.ed.ac.uk/blog/2018/07/16/high-performance-ray-tracing-room-acoustics

[12] David Oliva Elorza, "Room acoustics modeling using the raytracing method: implementation and evaluation", Licentiate Thesis, University of Turku Department of Physics, Finland 2005

[13] Jens Blauert, "Spatial Hearing: The Psychophysics of Human Sound Localization", The MIT Press, Cambridge, Mass., Revised Edition, 1997

[14] U. Meyer-Baese "Digital Signal Processing with Field Programmable Gate Arrays", Third Edition, Springer, 2007

[15] John G. Proakis and Dimitris G. Manolakis, "Digital Signal Processing: Principles, Algorithms, and Applications", Fourth Edition, Pearson, 2016

[16] Agnieszka Roginska and Paul Geluso, "Immersive Sound: The Art and Science of Binaural and Multi-Channel Audio", Audio Engineering Society Presents, Routledge, 2018.

[17] http://downloads.hindawi.com/archive/2013/608164.pdf

[18] http://en.benewake.com/product/detail/5c345cd0e5b3a844c472329b.html

[19] http://en.benewake.com/product/detail/5c345cc2e5b3a844c472329a.html

[20] Ying Tan "Handbook of Research on Design, Control, and Modeling of Swarm Robotics", IGI Global, 2016

[21] https://www.3dflow.net/3df-zephyr-pro-3d-models-from-photos/

[22] Edward M. Mikhail, James S. Bethel, and J. Chris McGlone, "Introduction to Modern Photogrammetry", John Wiley and Sons, 2001

[23] https://www.cs.princeton.edu/~funk/presence03.pdf

[24] https://i-simpa.ifsttar.fr/

[25] http://ease.afmg.eu/

[24] https://sourceforge.net/projects/fdac3dmod/

[24] https://www.raspberrypi.org/

[24] https://www.maxbotix.com/

All the above references are incorporated herein by reference.

What is claimed is:

1. A speaker system comprising:

a swarm system of inter-connected speaker arrays sharing multi-channel input audio channels, wherein the inter-connected speakers include a first speaker array that is mounted on a motion-controlled platform, wherein the swarm system is configured to control a positioning or orientation of the first speaker array based on (a) measurement data of a listening environment obtained using a three-dimensional model of the listening environment, and (b) a location of human listeners in the listening environment, wherein the swarm system is configured to:

receive tracking data indicating a first location of a human listener, adjust, based on the tracking data, the position or orientation of the first speaker array to a first position, detect a change in position of the human listener to a second location, and automatically readjust, based on the tracking data, the position or orientation of the first speaker array to a second position different from the first position, and wherein the first speaker array includes:

a cylindrical tube with an inner and outer diameter, a first type of speaker mounted in a space formed by the inner diameter, a plurality of second type of speakers mounted on an annular surface formed by one or more cross sections of the cylindrical tube around the space formed by the inner diameter, and a cylindrical enclosure to enclose the cylindrical tube.

2. A speaker system comprising:

a swarm system of inter-connected speaker arrays sharing multi-channel input audio channels, wherein the swarm system is configured to control a positioning or orientation of the inter-connected speaker arrays based on a location of human listeners in a listening environment, wherein the inter-connected speaker arrays include a first speaker array that includes:

a cylindrical tube with an inner and outer diameter, a first type of speaker mounted in a space formed by the inner diameter, a plurality of second type of speakers mounted on an annular surface formed by one or more cross sections of the cylindrical tube around the space formed by the inner diameter, and a cylindrical enclosure to enclose the cylindrical tube.

3. The speaker system of claim 2, wherein the first type of speaker is a subwoofer that produces low frequency sound.

4. The speaker system of claim 2, wherein the plurality of second type of speakers produces mid to high frequency sound, the first type and second type of speakers spanning entire audio signal spectrum.

5. The speaker system of claim 2, wherein each speaker of the plurality of second type of speakers is driven by an amplifier, and wherein the first type of speaker is driven by another amplifier.

6. The speaker system of claim 2, wherein the swarm system includes one or more sensors to generate measurement data related to a three-dimensional (3D) space in the listening environment where the inter-connected speaker arrays are located, the measurement data including information regarding the target location.

7. The speaker system of claim 6, wherein the swarm system is configured to control the positioning or orientation of each of the inter-connected speaker arrays based on the measurement data to maximize acoustic signals corresponding to the multi-channel input in reaching the target location.

8. The speaker system of claim 6, wherein the swarm system is configured to control the positioning or orientation of the first speaker array based on feedback data obtained from a feedback sensor positioned in the target location, wherein the feedback data is related to reception of audio signals from the first speaker array by the feedback sensor.

9. The speaker system of claim 2, wherein the swarm system is configured to control the positioning or orientation of the inter-connected speaker arrays based on tracking data related to a location of a human listener in the listening environment.

10. The speaker system of claim 9, wherein the swarm system is configured to receive the tracking data from a contact-based sensor located in the listening environment.

11. The speaker system of claim 9, wherein the swarm speaker system is configured to:

receive the tracking data indicating a first location of the human listener;

adjust the position or orientation of the first speaker array to a first position;

detect, based on the tracking data, a change in position of the human listener to a second location; and readjust the position or orientation of the first speaker array to a second position different from the first position.

12. The speaker system of claim 2, wherein the swarm system is configured to control the positioning or orientation of the inter-connected speaker arrays by moving the first speaker array to a first position on a floor, on a wall, or in the air of the listening environment.

13. The speaker system of claim 2, wherein the swarm system is configured to be static, moving, positioned on floor, flying airborne, tethered, untethered, autonomous, or centrally controlled.

14. A speaker system comprising:

a speaker array, wherein the speaker array includes:

a cylindrical tube with an inner diameter and an outer diameter;

a first speaker mounted in a space formed by the inner diameter, wherein the first speaker is a subwoofer that produces low frequency sound;

a plurality of speakers mounted on an annular surface formed by one or more cross sections of the cylindrical tube, wherein the plurality of speakers is mounted around the space formed by the inner diameter, wherein the plurality of speakers produces mid to high frequency sound; and a cylindrical enclosure to enclose the cylindrical tube.

15. The speaker system of claim 14, wherein each speaker of the plurality of speakers is driven by an amplifier, and wherein the first type of speaker is driven by another amplifier.

16. The speaker system of claim 14, wherein the speaker array includes one or more sensors to measure a three-dimensional (3D) space surrounding the speaker.

17. The speaker system of claim 14, wherein the speaker array is mounted on a motion-controlled platform.

18. The speaker system of claim 17, wherein the motion-controlled platform is configured to adjust a position or orientation of the speaker array in a listening environment based on measurement data associated with the listening environment and a location of human listeners in the listening environment.

19. The speaker system of claim 18, wherein the measurement data is obtained using a first sensor of the speaker system and the location of human listeners in the listening environment is obtained using a second sensor of the speaker system.

20. The speaker system of claim 14 further comprising:

a plurality of speaker arrays, wherein the plurality of speaker arrays is interconnected, share the input multichannel audio streams, suitably change orientations, positions, and generate audio outputs to maximize the listening experience of human listeners in the listening environment.

* * * * *